US005098456A

United States Patent [19]

Dray et al.

[11] Patent Number: 5,098,456

[45] Date of Patent: Mar. 24, 1992

[54] CRYOGENIC AIR SEPARATION SYSTEM WITH DUAL FEED AIR SIDE CONDENSERS

[75] Inventors: James R. Dray, Kenmore; David R. Parsnick, Tonawanda, both of N.Y.

[73] Assignee: Union Carbide Industrial Gases Technology Corporation, Danbury, Conn.

[21] Appl. No.: 544,642

[22] Filed: Jun. 27, 1990

[51] Int. Cl.[5] ..... F25J 3/02

[52] U.S. Cl. ..... 62/24; 62/38; 62/43

[58] Field of Search ..... 62/11, 13, 24, 38, 43

[56] References Cited

U.S. PATENT DOCUMENTS

| | | | |
|---|---|---|---|
| 2,712,738 | 7/1955 | Wucherer et al. | 62/175.5 |
| 2,915,882 | 12/1959 | Schuftan et al. | 62/30 |
| 3,059,440 | 10/1962 | Loporto | 62/11 |
| 3,102,801 | 9/1963 | Fetterman | 62/31 |
| 3,214,925 | 11/1965 | Becker | 62/13 |
| 3,269,130 | 8/1966 | Cost et al. | 62/30 |
| 3,280,574 | 10/1966 | Becker | 62/13 |
| 3,754,406 | 8/1973 | Allam | 62/41 |
| 3,905,201 | 9/1975 | Coveney et al. | 62/13 |
| 4,299,607 | 11/1981 | Okabe et al. | 62/13 |
| 4,345,925 | 8/1982 | Cheung | 62/13 |
| 4,560,398 | 12/1985 | Beddome et al. | 62/29 |
| 4,662,917 | 5/1987 | Cormier, Jr. et al. | 62/43 |
| 4,705,548 | 11/1987 | Agrawal et al. | 62/38 |
| 4,836,836 | 6/1989 | Bennett et al. | 62/22 |
| 4,895,583 | 1/1990 | Flanagan et al. | 62/24 |

*Primary Examiner*—Ronald C. Capossela
*Attorney, Agent, or Firm*—Stanley Ktorides

[57] ABSTRACT

A cryogenic air separation system comprising at least two columns wherein a portion of the feed air is turbo-expanded to generate refrigeration, one part is condensed against vaporizing product from the air separation plant, another portion of the feed air is condensed against vaporizing higher pressure product from the air separation plant, and all of the resulting feed air streams are fed into the same column to undergo separation.

20 Claims, 2 Drawing Sheets

CRYOGENIC AIR SEPARATION SYSTEM WITH DUAL FEED AIR SIDE CONDENSERS

TECHNICAL FIELD

This invention relates generally to cryogenic air separation and more particularly to the production of elevated pressure product gas from the air separation.

BACKGROUND ART

An often used commercial system for the separation of air is cryogenic rectification. The separation is driven by elevated feed pressure which is generally attained by compressing feed air in a compressor prior to introduction into a column system. The separation is carried out by passing liquid and vapor in countercurrent contact through the column or columns on vapor liquid contacting elements whereby more volatile component(s) are passed from the liquid to the vapor, and less volatile component(s) are passed from the vapor to the liquid. As the vapor progresses up a column it becomes progressively richer in the more volatile components and as the liquid progresses down a column it becomes progressively richer in the less volatile components. Generally the cryogenic separation is carried out in a main column system comprising at least one column wherein the feed is separated into nitrogen-rich and oxygen-rich components, and in an auxiliary argon column wherein feed from the main column system is separated into argon-richer and oxygen-richer components.

Often it is desired to recover product gas from the air separation system at an elevated pressure. Generally this is carried out by compressing the product gas to a higher pressure by passage through a compressor Such a system is effective but is quite costly. Moreover, it may also be desirable in some situations to produce liquid product from the air separation plant.

Accordingly it is an object of this invention to provide an improved cryogenic air separation system.

It is another object of this invention to provide a cryogenic air separation system for producing elevated pressure product gas while reducing or eliminating the need for product gas compression.

It is yet another object of this invention to provide a cryogenic air separation system for producing elevated pressure product gas while also producing liquid product.

SUMMARY OF THE INVENTION

The above and other objects which will become apparent to one skilled in the art upon a reading of this disclosure are attained by the present invention which comprises in general the turboexpansion of one portion of compressed feed air to provide plant refrigeration, the condensation of some of the turboexpanded feed against vaporizing liquid to produce lower pressure product gas, and the condensation of another portion of the feed air against a vaporizing liquid to produce higher pressure product gas.

More specifically one aspect of the present invention comprises:

Method for the separation of air by cryogenic distillation to produce product gas comprising:

(A) condensing at least some of a first portion of cooled compressed feed air and introducing resulting liquid into a first column of an air separation plant, said first column operating at a pressure generally within the range of from 60 to 100 psia;

(B) turboexpanding a second portion of the cooled, compressed feed air and introducing a first part of the resulting turboexpanded feed air into said first column;

(C) condensing at least some of a second part of the turboexpanded feed air and introducing the resulting fluid into said first column;

(D) separating the fluids introduced into said first column into nitrogen-enriched and oxygen-enriched fluids and passing said fluids into a second column of said air separation plant, said second column operating at a pressure less than that of said first column;

(E) separating the fluids passed into the second column into nitrogen-rich vapor and oxygen-rich liquid;

(F) withdrawing oxygen-rich liquid from the second column and vaporizing a first portion of the withdrawn oxygen-rich liquid by indirect heat exchange with the second part of the turboexpanded feed air to carry out the condensation of step (C);

(G) increasing the pressure of a second portion of the withdrawn oxygen-rich liquid and vaporizing the resulting liquid by indirect heat exchange with the first portion of the feed air to carry out the condensation of step (A); and (H) recovering vapor resulting from the heat exchange of steps (F) and (G) as product oxygen gas.

Another aspect of the present invention comprises:

Apparatus for the separation of air by cryogenic distillation to produce product gas comprising:

(A) an air separation plant comprising a first column, a second column, a reboiler, means to pass fluid from the first column to the reboiler and means to pass fluid from the reboiler to the second column;

(B) a first condenser, means to provide feed air to the first condenser and means to pass fluid from the first condenser into the first column;

(C) a turboexpander, means to provide feed air to the turboexpander and means to pass fluid from the turboexpander into the first column;

(D) a second condenser, means to pass fluid from the turboexpander to the second condenser and means to pass fluid from the second condenser into the first column;

(E) means to pass fluid from the air separation plant to the second condenser and means to recover product gas from the second condenser; and (F) means to pass fluid from the air separation plant to the first condenser said means comprising means to increase the pressure of said fluid, and means to recover product gas from the first condenser.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements. For a further discussion of distillation columns see the Chemical Engineers' Handbook, Fifth Edition, edited by R.H. Perry and C.H. Chilton, McGraw-Hill Book Company, New York, Section 13, "Distillation" B.D. Smith, et al., page 13-3 *The continuous Distillation Process.* The term, double column is used herein to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

As used herein, the term "argon column" means a column wherein upflowing vapor becomes progressively enriched in argon by countercurrent flow against descending liquid and an argon product is withdrawn from the column.

The term "indirect heat exchange", as used herein means the bringing of two fluid streams into heat exchange relation without any physical contact or intermixing of the fluids with each other.

As used herein, the term "vapor-liquid contacting elements" means any devices used as column internals to facilitate mass transfer, or component separation, at the liquid vapor interface during countercurrent flow of the two phases.

As used herein, the term "tray" means a substantially flat plate with openings and liquid inlet and outlet so that liquid can flow across the plate as vapor rises through the openings to allow mass transfer between the two phases.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "random packing" means packing wherein individual members do not have any particular orientation relative to each other or to the column axis.

As used herein, the term "structured packing" means packing wherein individual members have specific orientation relative to each other and to the column axis.

As used herein the term "theoretical stage" means the ideal contact between upwardly flowing vapor and downwardly flowing liquid into a stage so that the exiting flows are in equilibrium.

As used herein the term "turboexpansion" means the flow of high pressure gas through a turbine to reduce the pressure and temperature of the gas and thereby produce refrigeration. A loading device such as a generator, dynamometer or compressor is typically used to recover the energy.

As used herein the term "condenser" means a heat exchanger used to condense a vapor by indirect heat exchange.

As used herein the term "reboiler" means a heat exchanger used to vaporize a liquid by indirect heat exchange. Reboilers are typically used at the bottom of distillation columns to provide vapor flow to the vapor-liquid contacting elements.

As used herein the term "air separation plant" means a facility wherein air is separated by cryogenic rectification, comprising at least one column and attendant interconnecting equipment such as pumps, piping, valves and heat exchangers.

DETAILED DESCRIPTION

The invention will be described in detail with reference to the Drawings.

Figure 1:
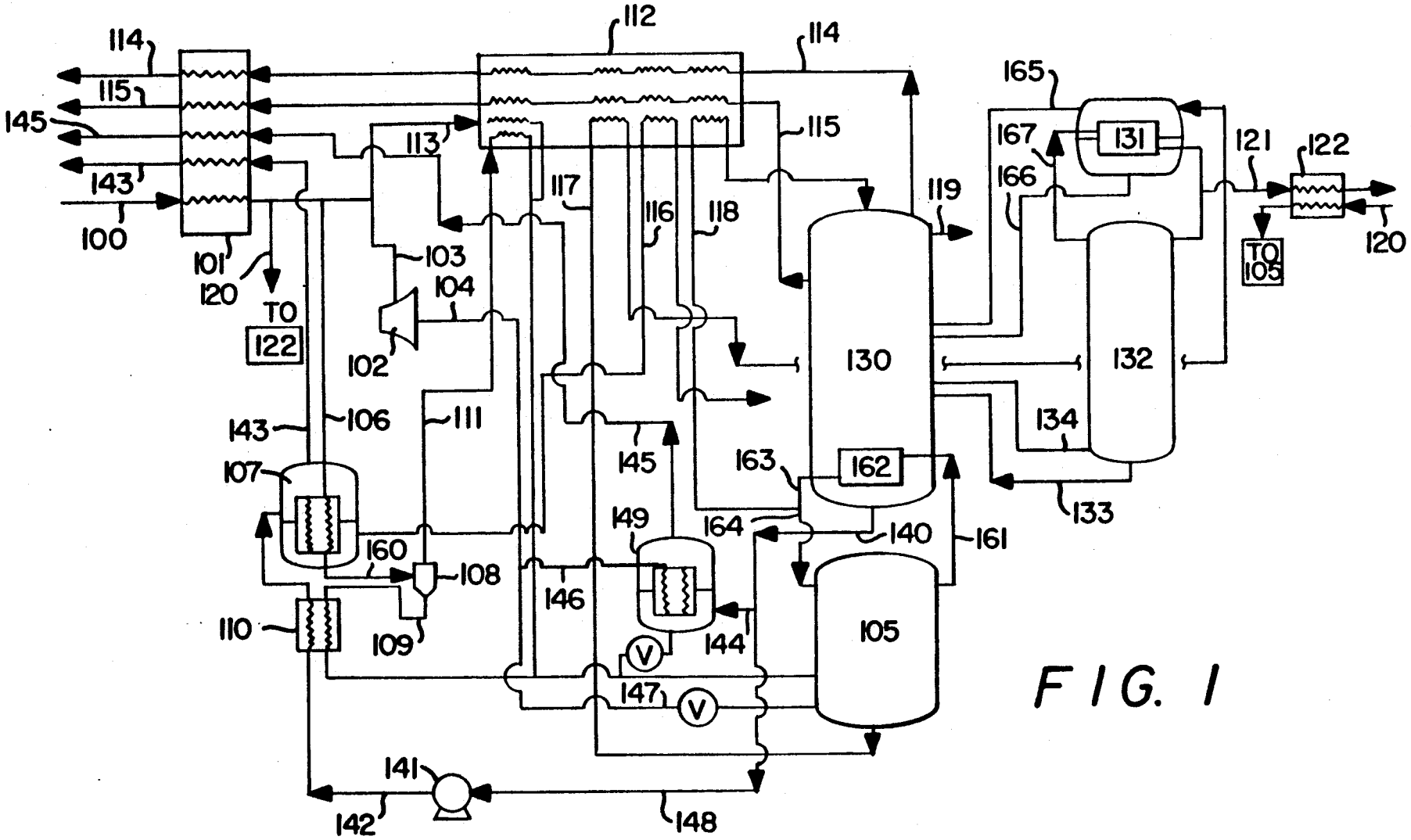
FIG. 1 is a simplified schematic flow diagram of one preferred embodiment of the cryogenic air separation system of this invention.

Referring now to FIG. 1 feed air 100 which has been compressed to a pressure generally within the range of from 90 to 500 pounds per square inch absolute (psia) is cooled by indirect heat exchange against return streams by passage through heat exchanger 101.

A first portion 106 of the cooled, compressed feed air is provided to condenser 107 wherein it is at least partially condensed by indirect heat exchange with vaporizing liquid taken from the air separation plant. Generally first portion 106 comprises from 5 to 35 percent of feed air 100. Resulting liquid is introduced into column 105 which is operating at a pressure generally within the range of from 60 to 100 psia. In the case where stream 106 is only partially condensed, resulting stream 160 may be passed directly into column 105 or may be passed, as shown in FIG. 1, to separator 108. Liquid 109 from separator 108 is then passed into column 105. Liquid 109 may be further cooled by passage through heat exchanger 110 prior to being passed into column 105. Cooling the condensed portion of the feed air improves liquid production from the process.

Vapor 111 from separator 108 may be passed directly into column 105 or may be cooled or condensed in heat exchanger 112 against return streams and then passed into column 105. Furthermore, a fourth portion 113 of the cooled compressed feed air may be cooled or condensed in heat exchanger 112 against return streams and then passed into column 105. Streams 111 and 113 can be utilized to adjust the temperature of the feed air fraction that is turboexpanded. For example, increasing stream 113 will increase warming of the return streams in heat exchanger 112 and thereby the temperature of feed air stream 103 will be increased. The higher inlet temperature to turboexpander 102 can increase the developed refrigeration and can control the exhaust temperature of the expanded air to avoid any liquid content. When the air separation plant includes an argon column, a third portion 120 of the cooled compressed feed air may be further cooled or condensed by indirect heat exchange, such as in heat exchanger 122, with fluid produced in the argon column and then passed into column 105.

A second portion 103 of the cooled compressed feed air is provided to turboexpander 102 and turboexpanded to a pressure generally within the range of from 60 to 100 psia. Generally second portion 103 will comprise from 60 to 90 percent of feed air 100. Resulting turboexpanded feed air 104 may be divided into first part 147 and second part 146. First part 147, comprising from 0 to 75 percent of turboexpanded second portion 104, if employed, is passed into column 105 at a point lower than the point where condensed first feed air portion is passed into column 105. Second part 146, comprising from 25 to 100 percent of turboexpanded second portion 104, is passed to condenser 149, wherein at least some of second part 146 is condensed and then passed into column 105. Preferably, as illustrated in FIG. 1, second part 146 is combined with the liquefied first feed air portion and passed into column 105.

Within first column 105 the fluids introduced into the column are separated by cryogenic distillation into nitrogen-enriched and oxygen-enriched fluids. In the embodiment illustrated in FIG. 1 the first column is the higher pressure column a double column system. Nitrogen-enriched vapor 161 is withdrawn from column 105 and condensed in reboiler 162 against boiling column 130 bottoms. Resulting liquid 163 is divided into stream 164 which is returned to column 105 as liquid reflux, and into stream 118 which is subcooled in heat exchanger 112 and flashed into second column 130 of the air separation plant. Second column 130 is operating at a pressure less than that of first column 105 and generally within the range of from 15 to 30 psia. Liquid nitrogen product may be recovered from stream 118 before it is flashed into column 130 or, as illustrated in FIG. 1, may be taken directly out of column 130 as stream 119 to minimize tank flashoff.

Oxygen-enriched liquid is withdrawn from column 105 as stream 117, subcooled in heat exchanger 112 and passed into column 130. In the case where the air separation plant includes an argon column, as in the embodiment illustrated in FIG. 1, all or part of stream 117 may be flashed into condenser 131 which serves to condense argon column top vapor. Resulting streams 165 and 166 comprising vapor and liquid respectively are then passed from condenser 131 into column 130.

Within column 130 the fluids are separated by cryogenic distillation into nitrogen-rich vapor and oxygen-rich liquid. Nitrogen-rich vapor is withdrawn from column 130 as stream 114, warmed by passage through heat exchangers 112 and 101 to about ambient temperature and recovered as product nitrogen gas. For column purity control purposes a nitrogen-rich waste stream 115 is withdrawn from column 130 at a point between the nitrogen-enriched and oxygen-enriched feed stream introduction points, and is warmed by passage through heat exchangers 112 and 101 before being released to the atmosphere. Nitrogen recoveries of up to 90 percent or more are possible by use of this invention.

As mentioned the embodiment illustrated in FIG. 1 includes an argon column in the air separation plant. In such an embodiment a stream comprising primarily oxygen and argon is passed 134 from column 130 into argon column 132 wherein it is separated by cryogenic distillation into oxygen-richer liquid and argon-richer vapor. Oxygen-richer liquid is returned as stream 133 to column 130. Argon-richer vapor is passed 167 to argon column condenser 131 and condensed against oxygen-enriched fluid to produce argon-richer liquid 168. A portion 169 of argon-richer liquid is employed as liquid reflux for column 132. Another portion 121 of the argon-richer liquid is recovered as crude argon product generally having an argon concentration exceeding 96 percent. As illustrated in FIG. 1, crude argon product stream 121 may be warmed or vaporized in argon column heat exchanger 122 against feed air stream 120 prior to further upgrading and recovery.

Oxygen-rich liquid 140 is withdrawn from column 130 and preferably pressurized to a pressure greater than that of column 130 by either a change in elevation, i.e. the creation of liquid head as illustrated in FIG. 1, by pumping, by employing a pressurized storage tank, or by any combination of these methods. The withdrawn liquid is divided into first portion 144 comprising from 10 to 90 percent of withdrawn liquid 140, and into second portion 148 comprising from 10 to 90 percent of withdrawn liquid 140. First portion 144 is then passed into condenser or product boiler 149 where it is vaporized by indirect heat exchange with the condensing second part of the turboexpanded feed air. Gaseous product oxygen 145 is passed from condenser 149, warmed through heat exchanger 101 and recovered as lower pressure product oxygen gas. As used herein the term "recovered" means any treatment of the gas or liquid including venting to the atmosphere. Liquid oxygen may also be recovered from stream 140 or condenser 149.

The second portion 148 of the withdrawn liquid is pressurized to a pressure greater than that of the first portion such as by the creation of liquid head and by passage through pump 141 as illustrated in FIG. 1. Resulting higher pressure liquid 142 is then warmed by passage through heat exchanger 110 and throttled into condenser or product boiler 107 where it is at least partially vaporized by indirect heat exchange with the condensing first portion of the feed air. Gaseous product oxygen 143 is passed from condenser 107, warmed through heat exchanger 101 and recovered as higher pressure product oxygen gas. Liquid 116 may be taken from condenser 107, subcooled by passage through heat exchanger 112 and recovered as product liquid oxygen. Generally the pressure of lower pressure oxygen product gas will be within the range of from 20 to 35 psia and the pressure of the higher pressure oxygen product gas will be within the range of from 40 to 250 psia.

The oxygen content of the liquid from the bottom of column 105 is lower than in a conventional process which does not utilize an air condenser. This changes the reflux ratios in the bottom of column 105 and all sections of column 130 when compared to a conventional process. High product recoveries are possible with the invention since refrigeration is produced without requiring vapor withdrawal from column 105 or an additional vapor feed to column 130.

Producing refrigeration by adding vapor air from a turbine to column 130 or removing vapor nitrogen from column 105 to feed a turbine would reduce the reflux ratios in column 130 and significantly reduce product recoveries. The invention is able to easily maintain high reflux ratios, and hence high product recoveries and high product purities. Oxygen recoveries of up to 99.9 percent are possible by use of the system of this invention. Oxygen product may be recovered at a purity generally within the range of from 95 to 99.95 percent.

Additional flexibility could be gained by splitting the feed air before it enters heat exchanger 101. The air could be supplied at two different pressures if the liquid production requirements don't match the product pressure requirements. Increasing product pressure will raise the air pressure required at the product boilers, while increased liquid requirements will increase the air pressure required at the turbine inlet.

Figure 2:
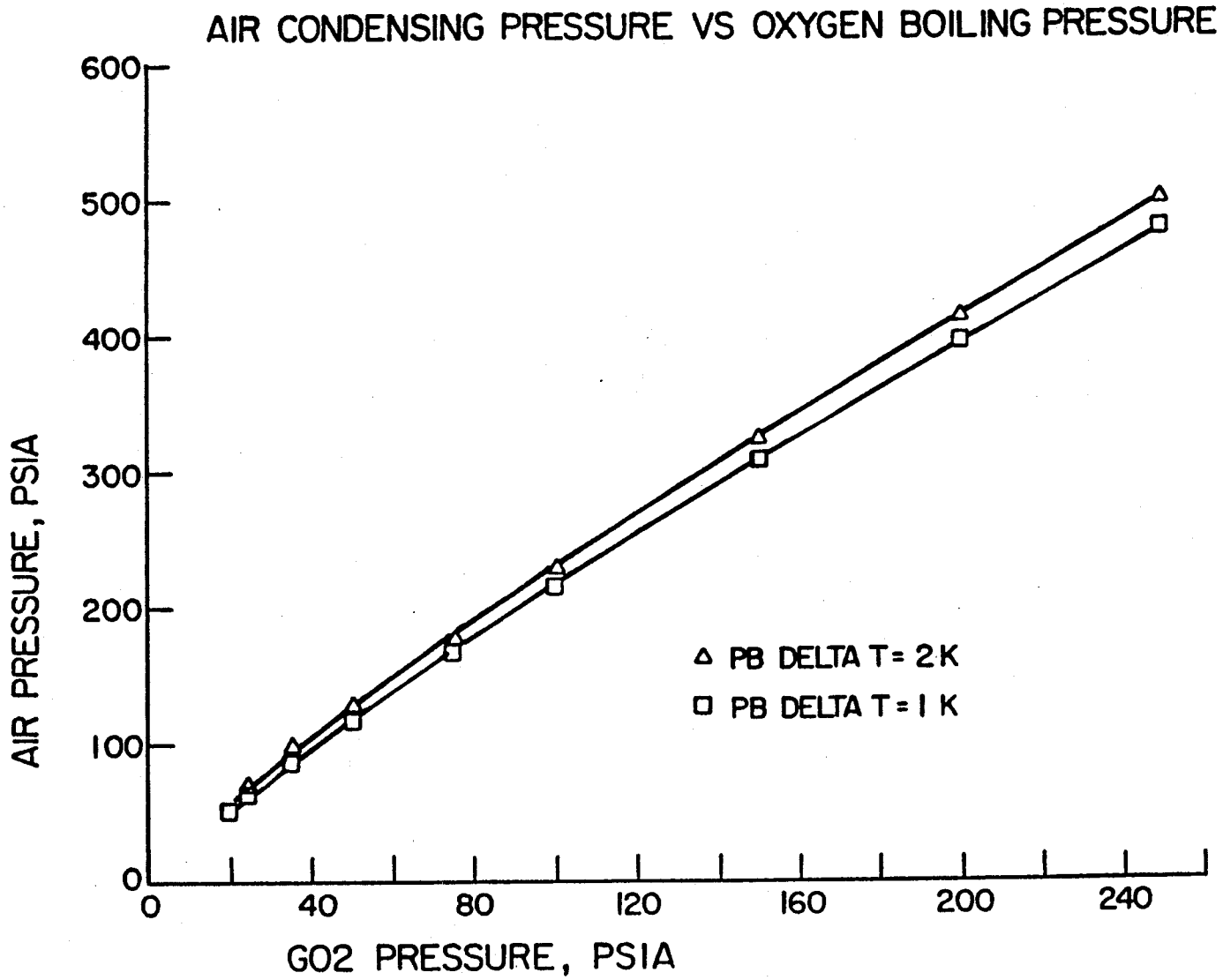
FIG. 2 is a graphical representation of air condensing pressure against oxygen boiling pressure.

The embodiment illustrated in FIG. 1 illustrates the condensation of air feed to produce product oxygen gas. FIG. 2 illustrates the air condensing pressure required to produce oxygen gas product over a range of pressures for product boiling delta T's of 1 and 2 degrees K. There will be a finite temperature difference (delta T) between streams in any indirect heat exchanger. Increasing heat exchanger surface area and/or heat transfer coefficients will reduce the temperature difference (delta T) between the streams. For a fixed oxygen pressure requirement, decreasing the delta T will allow the air pressure to be reduced, decreasing the energy required to compress the air and reducing operating costs.

Net liquid production will be affected by many parameters. Turbine flows, pressures, inlet temperatures, and efficiencies will have significant impact since they determine the refrigeration production. Air inlet pressure, temperature, and warm end delta T will set the warm end losses. The total liquid production (expressed as a fraction of the air) is dependent on the air pressures in and out of the turbine, turbine inlet temperature, turbine efficiency, primary heat exchanger inlet temperature and amount of product produced as higher pressure gas. The gas produced as higher pressure product requires power input to the air compressor to replace product compressor power.

Recently packing has come into increasing use as vapor-liquid contacting elements in cryogenic distillation in place of trays. Structured or random packing has the advantage that stages can be added to a column without significantly increasing the operating pressure of the column. This helps to maximize product recoveries, increases liquid production, and increases product purities. Structured packing is preferred over random packing because its performance is more predictable. The present invention is well suited to the use of structured packing. In particular, structured packing may be particularly advantageously employed as some or all of the vapor-liquid contacting elements in the second or lower pressure column and, if employed, in the argon column.

The high product delivery pressure attainable with this invention will reduce or eliminate product compression costs. In addition, if some liquid production is required, it can be produced by this invention with relatively small capital costs. The two side condensers reduce or eliminate the need for product compression, whereas the feed air expansion allows the production of liquid without loss of product recovery.

Although the invention has been described in detail with reference to a certain embodiment, those skilled in the art will recognize that there are other embodiments within the spirit and scope of the claims.

We claim:

1. Method for the separation of air by cryogenic distillation to produce product gas comprising:

(A) condensing at least some of a first portion of cooled compressed feed air and introducing resulting liquid into a first column of an air separation plant, said first column operating at a pressure generally within the range of from 60 to 100 psia;

(B) turboexpanding a second portion of the cooled, compressed feed air and introducing a first part of the resulting turboexpanded feed air into said first column;

(C) condensing at least some of a second part of the turboexpanded feed air and introducing the resulting fluid into said first column;

(D) separating the fluids introduced into said first column into nitrogen-enriched and oxygen-enriched fluids and passing said fluids into a second column of said air separation plant, said second column operating at a pressure less than that of said first column;

(E) separating the fluids passed into the second column into nitrogen-rich vapor and oxygen-rich liquid;

(F) withdrawing oxygen-rich liquid from the second column and vaporizing a first portion of the withdrawn oxygen-rich liquid by indirect heat exchange with the second part of the turboexpanded feed air to carry out the condensation of step (C);

(G) increasing the pressure of a second portion of the withdrawn oxygen-rich liquid and vaporizing the resulting liquid by indirect heat exchange with the first portion of the feed air to carry out the condensation of step (A); and (H) recovering vapor resulting from the heat exchange of steps (F) and (G) as product oxygen gas.

2. The method of claim 1 wherein the liquid resulting from the condensation of the first portion of the feed air is further cooled prior to being introduced into the first column.

3. The method of claim 1 wherein the second portion of the withdrawn oxygen-rich liquid is warmed prior to its vaporization against the condensing first portion of the feed air.

4. The method of claim 1 wherein the liquid resulting from step (A) is introduced into the first column at a point higher than the vapor resulting from step (B).

5. The method of claim 1 wherein the air separation plant further comprises an argon column, a stream is passed from the second column to the argon column and separated into argon-richer vapor and oxygen-richer liquid, the argon-richer vapor is condensed and at least some is recovered.

6. The method of claim 5 wherein the argon-richer vapor is condensed by indirect heat exchange with oxygen-enriched fluid to produce argon-richer liquid.

7. The method of claim 6 wherein argon-richer liquid is vaporized by indirect heat exchange with a third portion of the cooled, compressed feed air and the resulting condensed third portion is passed into the first column.

8. The method of claim 1 wherein the first portion of the feed air is partially condensed, the resulting vapor is subsequently condensed and is then introduced into the first column.

9. The method of claim 1 comprising withdrawing liquid from the air separation plant and recovering said liquid as product liquid.

10. The method of claim 9 wherein said product liquid is nitrogen-enriched fluid.

11. The method of claim 9 wherein said product liquid is oxygen-rich liquid.

12. The method of claim 1 further comprising cooling a fourth portion of the feed air having a pressure higher than that of the turboexpanded second portion of the feed air, by indirect heat exchange with fluid taken from the air separation plant and passing the resulting fourth portion into the first column.

13. The method of claim 1 further comprising recovering nitrogen-rich vapor as product nitrogen gas.

14. Apparatus for the separation of air by cryogenic distillation to produce product gas comprising:

(A) an air separation plant comprising a first column, a second column, a reboiler, means to pass fluid from the first column to the reboiler and means to pass fluid from the reboiler to the second column;

(B) a first condenser, means to provide feed air to the first condenser and means to pass fluid from the first condenser into the first column;

(C) a turboexpander, means to provide feed air to the turboexpander and means to pass fluid from the turboexpander into the first column;

(D) a second condenser, means to pass fluid from the turboexpander to the second condenser and means to pass fluid from the second condenser into the first column;

(E) means to pass fluid from the air separation plant to the second condenser and means to recover product gas from the second condenser; and (F) means to pass fluid from the air separation plant to the first condenser said means comprising means to increase the pressure of said fluid, and means to recover product gas from the first condenser.

15. The apparatus of claim 14 further comprising means to increase the temperature of the fluid passed from the air separation plant to the first condenser.

16. The apparatus of claim 14 wherein the air separation plant further comprises an argon column and means to pass fluid from the second column into the argon column.

17. The apparatus of claim 16 further comprising an argon column condenser, means to provide vapor from the argon column to the argon column condenser, means to pass liquid from the argon column condenser to an argon column heat exchanger, means to provide feed air to the argon column heat exchanger and from the argon column heat exchanger into the first column.

18. The apparatus of claim 16 wherein the argon column contains vapor liquid contacting elements comprising structured packing.

19. The apparatus of claim 14 wherein the first column contains vapor-liquid contacting elements comprising structured packing.

20. The apparatus of claim 14 wherein the second column contains vapor-liquid contacting elements comprising structured packing.

* * * * *